US010954761B2

(12) United States Patent
Von Kaenel et al.

(10) Patent No.: US 10,954,761 B2
(45) Date of Patent: Mar. 23, 2021

(54) MODULAR CHARGE HOLDER SEGMENT

(71) Applicant: Halliburton Energy Services, Inc., Houston, TX (US)

(72) Inventors: Scott Randall Von Kaenel, Fort Worth, TX (US); Richard Ellis Robey, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/908,053

(22) Filed: Jun. 22, 2020

(65) Prior Publication Data

US 2020/0318465 A1 Oct. 8, 2020

Related U.S. Application Data

(62) Division of application No. 15/565,556, filed as application No. PCT/US2016/069369 on Dec. 30, 2016, now Pat. No. 10,731,443.

(51) Int. Cl.
*E21B 43/117* (2006.01)
*E21B 43/263* (2006.01)

(52) U.S. Cl.
CPC ..... *E21B 43/117* (2013.01); *E21B 43/263* (2013.01)

(58) Field of Classification Search
CPC ..... E21B 43/11; E21B 43/116; E21B 43/117; E21B 43/119
See application file for complete search history.

(56) References Cited

U.S. PATENT DOCUMENTS 2,742,857 A 4/1956 Turechek
4,191,265 A 3/1980 Bosse-Platiere
4,598,775 A 7/1986 Vann et al.
(Continued)

FOREIGN PATENT DOCUMENTS

CA 2344752 A1 10/2001
FR 3073617 A1 5/2019
(Continued)

OTHER PUBLICATIONS

International Search Report and Written Opinion issued in related PCT Application No. PCT/US2016/069369 dated Sep. 25, 2017, 15 pages.

*Primary Examiner* — Gabriel J. Klein
(74) *Attorney, Agent, or Firm* — John W. Wustenberg; Baker Botts L.L.P.

(57) ABSTRACT

A perforating tool assembly may be modularized by providing modular charge segments to provide for multiple configurations of shaped charges without the requirement of excess inventory. The modular charge segments may comprise any number of modular charge holder segments and modular charge spacer segments which are configured to provide for different spacings and offsets of shaped charges disposed within the modular charge holder segments. The modular charge holder segments include slots and locking tabs to allow for the differing offsets between charges. The modular charge holder segments may comprise a slit that allows the modular holder segment to be flexed or deflected to permit the loading and downloading of shaped charges. The modular charge segments may comprise a plastic or rubber material to provide for safer deployment of shaped charges downhole.

9 Claims, 8 Drawing Sheets

(56) References Cited

U.S. PATENT DOCUMENTS

| | | | | |
|---|---|---|---|---|
| 6,851,471 | B2 * | 2/2005 | Barlow | E21B 17/042 102/307 |
| 7,934,558 | B2 | 5/2011 | Hales | |
| 10,174,595 | B2 * | 1/2019 | Knight | E21B 43/117 |
| 2003/0047358 | A1 * | 3/2003 | Bonkowski | E21B 43/119 175/4.6 |
| 2008/0149338 | A1 | 6/2008 | Goodman | |
| 2013/0098681 | A1 | 4/2013 | Zhang | |
| 2013/0192829 | A1 | 8/2013 | Fadul et al. | |
| 2016/0168961 | A1 | 6/2016 | Parks et al. | |
| 2019/0040722 | A1 | 2/2019 | Yang | |

FOREIGN PATENT DOCUMENTS

| | | | | |
|---|---|---|---|---|
| WO | 2010-043941 | A1 | 4/2010 | |
| WO | 2015-006869 | A1 | 1/2015 | |
| WO | WO-2015006869 | A1 * | 1/2015 | E21B 43/117 |
| WO | 2015-179698 | A2 | 11/2015 | |
| WO | 2018-183360 | A1 | 10/2018 | |

* cited by examiner

MODULAR CHARGE HOLDER SEGMENT

CROSS REFERENCE TO RELATED APPLICATIONS

The present application is a Divisional of U.S. patent application Ser. No. 15/565,556 filed Oct. 10, 2017, which is a U.S. National Stage Application of International Application No. PCT/US2016/069369 filed Dec. 30, 2016, both of which are incorporated herein by reference in their entirety for all purposes.

BACKGROUND

The present disclosure relates generally to systems and methods for servicing a wellbore, and more particularly to perforating tool assemblies, for example, one or more modular charge segments for a perforating tool assembly.

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

Wellbores are drilled into the earth for a variety of purposes including tapping into hydrocarbon bearing formations to extract the hydrocarbons for use as fuel, lubricants, chemical production, and other purposes. When a wellbore has been completed, a casing may be placed and cemented in the wellbore. Thereafter, a perforating tool assembly may be run into the casing, and one or more perforating guns in the perforating tool assembly may be activated, fired, actuated, or otherwise caused to explode an explosive charge to perforate the casing, the formation or both to promote production of hydrocarbons from selected formations. Perforating tool assemblies may comprise one or more perforating guns. The perforating guns may comprise one or more explosive charges.

Whatever the type of explosive charges used to create perforations or fractures, the perforating tool assembly must be configured to deploy the explosive charge (shaped charge) downhole and to align or offset the explosive charges as required by a given operation. A well site may need to inventory various perforating tool assemblies to accomplish the desired operation. Thus, a need exists for modular perforating tool assemblies that are configurable for a given explosive charge and for a given operation.

DETAILED DESCRIPTION

Figure 1:
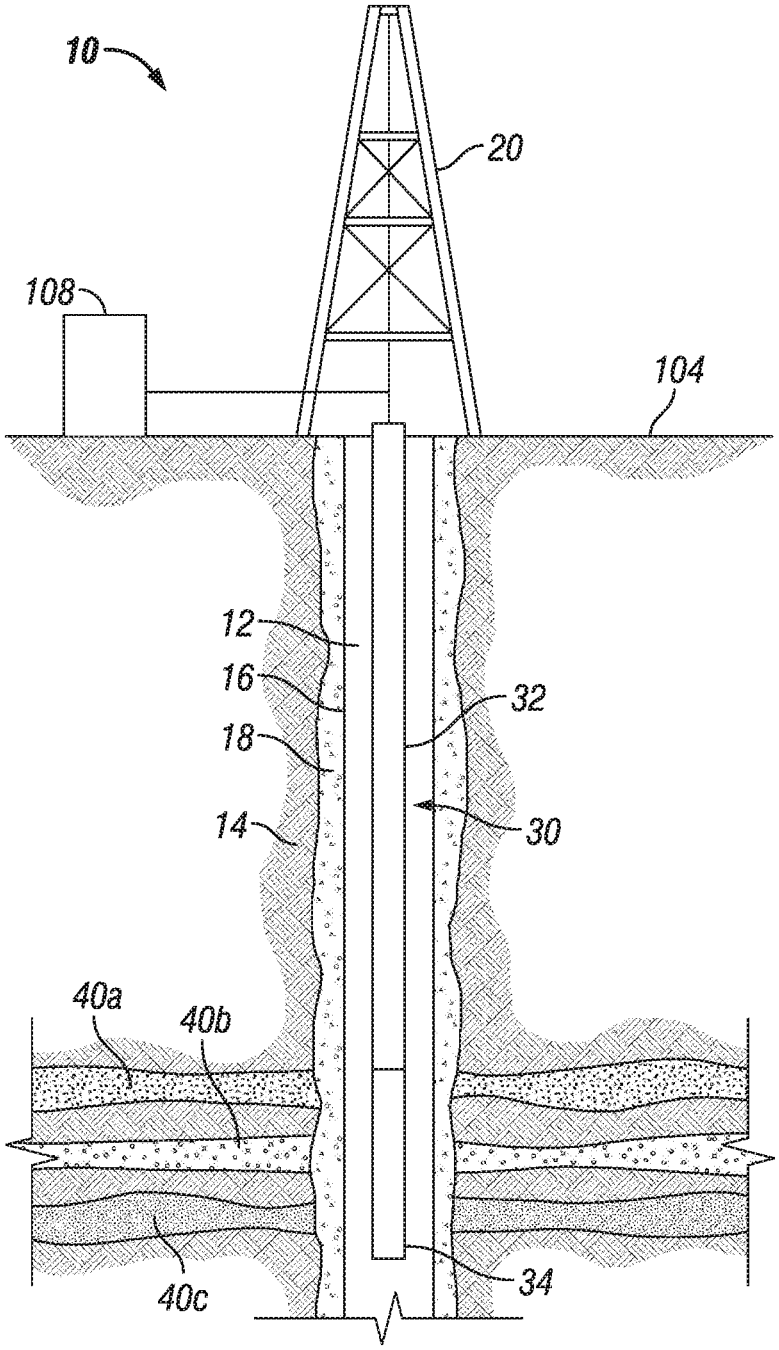
FIG. 1 is a schematic diagram depicting an example of a wellbore environment for utilization of a modular perforating tool assembly, according to one aspects of the present disclosure.

Certain aspects and examples of the present disclosure relate to perforating tool assemblies for use in deploying one or more explosive charges downhole. To create a desired perforation or fracture within a casing of a wellbore or a subterranean formation may require that an explosive charge or perforating charge be deployed within a perforating tool assembly at a precise location within the wellbore and that the one or more explosive charges be disposed at a precise orientation, offset, distance or any combination thereof in relation to each other within the perforating tool assembly. Providing modular charge segments, including at least modular charge holder segments and modular charge spacer segments, allows for the explosive charges to be deployed in a variety of configurations without the need for storing or inventorying many different components to provide for the required different configurations for a given operation. For example, an operation may require that a first perforating tool assembly comprise shaped charges that comprise explosive material disposed a first predetermined distance apart and at a first offset from each other. After exploding the shaped charges, the operation may then require that a second perforating tool assembly comprise shaped charges disposed a second predetermined distance apart and at a second offset from each other. Modular charge segments provide for these different configurations without the need for the inventory of multiple perforating tool assemblies. Providing modular charge segments may reduce costs associated with inventory and may allow for greater flexibility in configurations for shaped charges and for real-time adjustments of a drilling operation. Thus, modular charge segments enable ease of interchangeability of shaped charges, increased efficiency in assembly perforating tool assemblies and elimination of safety risks due to unintended activation of the shaped charges.

According to the present disclosure, modular charge segments, including at least modular charge holder segments and modular charge spacer segments, may allow for single design for mass production (which may reduce costs), multi-phasing capability of shaped charges, shot per foot adjustment of shaped charges, self-locking for shaped charges, integrated connection for a detonation cord, elimination of secondary components reduction in inventory, diversification of manufacturing processes, safety enhancements due to non-conductive material, reduction in assembly time, accommodation for customer specific applications, and real-time ability to alter a configuration, and any other safety and reduction in costs as discussed further herein.

The modular charge segments of a perforating tool assembly may be deployed into the wellbore during any suitable downhole operation. For example, in one embodiment the modular charge segments of a perforating tool assembly may be deployed downhole to facilitate a fracturing operation. In one or more embodiments, the modular charge segments of a perforating tool assembly may be deployed downhole for stimulating a hydrocarbon-producing formation, during a plug and abandonment process to aid in filling any openings into the formation, wellbore repair, or for any other suitable operation.

Detailed descriptions of certain examples are discussed below. These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative examples but, like the illustrative examples, should not be used to limit the present disclosure. The various figures described below depict examples of implementations for the present disclosure, but should not be used to limit the present disclosure.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "1A" refers to an instance of a widget class, which may be referred to collectively as widgets "1" and any one of which may be referred to generically as a widget "1". In the figures and the description, like numerals are intended to represent like elements.

To facilitate a better understanding of the present disclosure, the following examples of certain embodiments are given. In no way should the following examples be read to limit, or define, the scope of the disclosure.

Various aspects of the present disclosure may be implemented in various environments. For example, FIG. 1 is a diagram depicting an example of a wellbore environment for utilization of a modular perforating tool assembly, according to one aspects of the present disclosure. The system 10 comprises servicing rig 20 that extends over and around a wellbore 12 that penetrates a subterranean formation 14 for the purpose of recovering hydrocarbons from a first production zones 40*a*, a second production zone 40*b*, a third production zones 40*c*, or any combination thereof (collectively, production zones 40). The wellbore 12 may be drilled into the subterranean formation 14 using any suitable drilling technique. While shown as extending vertically from the surface in FIG. 1, the wellbore 12 may also be deviated, horizontal, curved, curved at least at some portions of the wellbore 12, or any combination thereof. For example, the wellbore 12, or a lateral wellbore drilled off of the wellbore 12, may deviate and remain within one of the production zones 40. The wellbore 12 may be cased, open hole, contain tubing, and may generally comprise a hole in the ground having a variety of shapes or geometries as is known to those of skill in the art. In the illustrated embodiment, a casing 16 may be disposed in the wellbore 12 and secured, for example, by (at least in part) cement 18.

The servicing rig 20 may be one of a drilling rig, a completion rig, a workover rig, or other mast structure and may support a tubing string 30 in the wellbore 12. The tubing string 30 may comprise segmented pipes that extend below the surface 104 and into the wellbore 12. The present disclosure contemplates any suitable structure for supporting tubing string 30. The servicing rig 20 may also comprise a derrick with a rig floor through which the tubing string 30 extends downward from the servicing rig 20 into the wellbore 12. In some embodiments, such as in an off-shore location, the servicing rig 20 may be supported by piers extending downwards to a seabed. Alternatively, in some embodiments, the servicing rig 20 may be supported by columns sitting on hulls and/or pontoons that are ballasted below the water surface, which may be referred to as a semi-submersible platform or rig. In an off-shore location, a casing 16 may extend from the servicing rig 20 to exclude sea water and contain drilling fluid returns. It is understood that other mechanical mechanisms, not shown, may control the run-in and withdrawal of the tubing string 30 in the wellbore 12, for example a draw works coupled to a hoisting apparatus, another servicing vehicle, a coiled tubing unit and/or other apparatus.

In one or more embodiments, the tubing string 30 may comprise a conveyance 32 and a perforating tool assembly 34 that comprises one or more embodiments of the present disclosure. The perforating tool assembly 34 may also be downhole deployment device or tool suitable for deploying the perforating tool assembly 34 downhole. The conveyance 32 may be any of a string of jointed pipes, a slickline, a coiled tubing, and a wireline. For example, a wireline may be coupled to a truck or other logging facility. In one or more embodiments, the tubing string 30 may further comprise one or more downhole tools (not shown in FIG. 1), for example above the perforating tool assembly 34. The tubing string 30 may comprise one or more packers, one or more completion components such as screens and/or production valves, sensing and/or measuring equipment, and other equipment which are not shown in FIG. 1. In some contexts, the tubing string 30 may be referred to as a tool string. The tubing string 30 may be lowered into the wellbore 12 to position the perforating tool assembly 34 to perforate the casing 16 and penetrate one or more production zones 40.

The perforating tool assembly 34 may be coupled via an electrical connection to a system control unit 108 at the surface 104. In one or more embodiments, system control unit 108 may be positioned downhole or remote from the system 10. A command signal may be transmitted from the system control unit 108 to the perforating tool assembly 34 to cause the perforating tool assembly 34 to perform one or more operations or to alter one or more operations of the perforating tool assembly 34.

Figure 2:
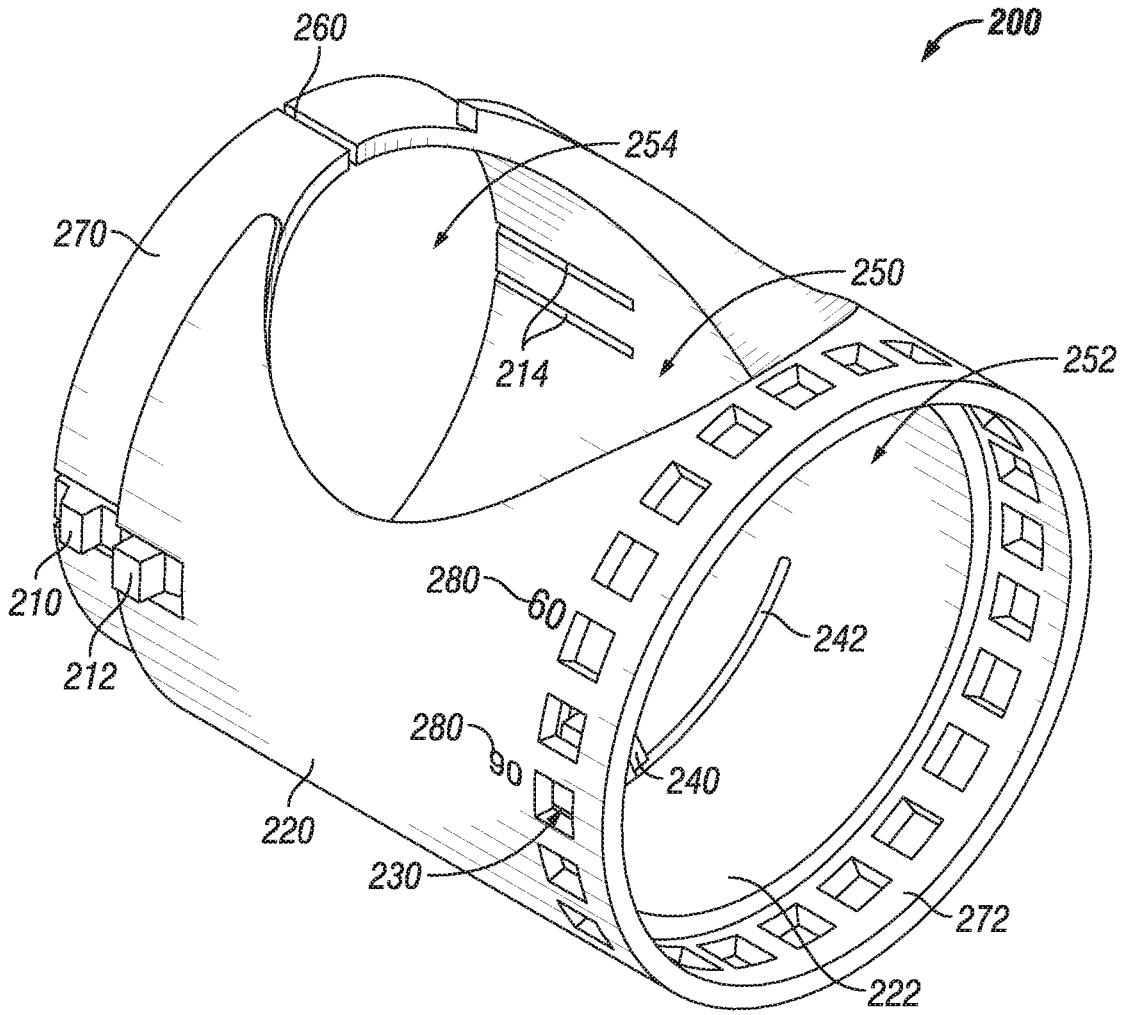
FIG. 2 is a diagram illustrating an example modular charge holder segment, according to aspects of the present disclosure.

FIG. 2 is a diagram that illustrates an example modular charge holder segment 200 of a perforating tool assembly 34, according to aspects of the present disclosure. In one or more embodiments the modular charge holder segment 200 is disposed in a perforating tool assembly 34 or any other tool or device suitable for deploying the modular charge holder segment 200 downhole. The modular charge holder segment 200 secures a shaped charge, for example an explosive or a perforating charge (see, for example, element 410 in FIG. 4A), in a predetermined location and orientation. The modular charge holder segment 200 provides interchangeability for a number of shots (explosions of the shaped charge) per foot and a degree of phasing from one shaped charge to another. A reduction in inventory of a variety of perforating tool assemblies 34 necessary to provide commonly used phasing and shots per foot as the modular charge holder segment 200 may be configured in one or more configurations to accommodate a variety of phasing and shots per foot. The modular charge holder segment 200 is also amenable to bulk production as the modular charge holder segment 200 may be molded or three-dimensionally printed which are conducive for mass production. In one or more embodiments, the modular charge holder segment 200 may eliminate some potential safety risks as the modular charge holder segment 200 may comprise a rubber, plastic or other non-conductive material which reduces the risk of unintended detonation or shorting. Also, modular charge holder segments 200 comprising such materials may reduce the potential amount of debris that may be detrimental to downhole conditions as the material may be totally or substantially consumed or sufficiently pulverized. The modular charge holder segment 200 may also increase efficiency in loading and downloading the shaped charges as the shaped charges are easily inserted into and removed from the modular charge holder segment 200.

Shaped charges (such as shaped charges 410 illustrated in FIG. 4A) may be disposed in a charge opening 250 formed in the modular charge holder segment 200. In current assemblies, shaped charges are placed in predetermined slots at a given or specified spacing and degree of phasing between the shaped charges as determined by the particular assembly which may generally comprise a single manufactured carbon and alloy steel mechanical tubing. The modular charge holder segment 200 includes a charge opening 250 that may orient a shaped charge at different degrees of phasing and spacing by coupling the modular charge holder segment 200 with one or more other modular charge holder segments 200 as discussed with respect to FIG. 4A and FIG. 4B. Charge opening 250 may be of any shape, size, dimension or combination thereof to accommodate or allow a shaped charge to be disposed within the modular charge holder segment 200.

The modular charge holder segment 200 comprises an opening 254 and 252 at each end of the modular charge holder segment 200. The openings 254 and 252 allow for the modular charge holder segment 200 to couple to one or more other modular charge holder segments 200. For example, opening 254 may be adjacent to male connector 270 and opening 252 may be adjacent to female connector 272. Male connector 270 of a first modular charge holder segment 200 may receive the female connector 272 of a second modular charge holder segment 200. Male connector 270 may be a recessed portion of the modular charge holder segment 200 sufficient to allow insertion into a female connector 272. Inner surface 222 may form a recessed edge with the female connector 272 so that the female connector 272 receives the male connector 270.

The male connector 270 may comprise one or more locking tabs 210. Locking tabs 210 may comprise clips, cantilever snap joints, cantilever arms, cantilever lugs or any other device or mechanism that flexes or locks to secure modular charge segments. Locking tab 210 of a first modular charge holder segment 200 is configured to mate with a slot 230 to secure or couple a second modular charge holder segment 200 with the first modular charge holder segment 200. For example, the locking tab 210 may be configured to deflect or flex to enable mating. The male connector 270 of the first modular charge holder segment 200 slides or otherwise is positioned within the female connector 272 of the second modular charge holder segment 200 such that the locking tab 210 mates with a slot 230 to position the shaped charge at the desired or predetermined orientation. Locking tab 210 may comprise a fastener, a coupler, a cantilever arm, a latch, or any other mechanism for mating the locking tab 210 with a slot 230. One or more release tabs 212 may be disposed on the modular charge holder segment 200. Release tab 212 is configured or operates to release the locking tab 210 such that the first modular charge holder segment 200 may be removed or decoupled from the second modular charge holder segment 200. In one or more embodiments, release tab 212 may not be present as locking tab 210 may be depressed or otherwise unlocked from a corresponding slot 230. In one or more embodiments, locking tab slits 214 are configured to allow the locking tab 210 and the release tab 212 to be depressed, flexed, or deflected so as to allow a first modular charge holder segment 200 to be coupled to or released from a second modular charge holder segment 200. Once the release tab 212 is locked or secured in slot 230, the rotational and linear movement of the shaped charges is limited or prevented.

In one or more embodiments, at, near or proximate to one or more slots 230 a corresponding indicator 280 may be disposed to indicate an orientation or phasing of a shaped charge disposed within the modular charge holder segment 200. While FIG. 2 illustrates the slots 230 spaced so as to position a shaped charge at intervals of fifteen degrees of offset or phasing (for example, 60, 75, 90, 105, 120, etc.), the present disclosures contemplates that the slots 230 may be spaced at any suitable distance apart to position the shaped charge of a modular charge holder segment 200 at the desired or predetermined offset or phasing. While FIG. 2 illustrates indicators 280 associated with slots 230 for a sixty, ninety, etc. degree offsets or phasings, the present disclosure contemplates that indicators 280 may indicate any degree of offset or phasing and may be associated with any one or more slots 230. Indicator 280 may comprise a label, identifier, or other visual indicator. Indicator 280 may be applied or otherwise affixed to an outer surface 220 (as illustrated) or inner surface 222 of the modular charge holder segment 200. Indicator 280 may be applied via any one or more suitable applicators including but not limited to screen printing, painting, adhesively, etched, laser printed, or any other suitable applicator or combination thereof. In one or more embodiments, the slots 230 may be disposed on the modular charge holder segment 200 in a 360 degree pattern such that the slots 230 circumnavigate the modular charge holder segment 200. In one or more embodiments, the slots 230 may be disposed at any interval or location of the modular charge holder segment 200. For example, slots 230 may be disposed on one side, halfway, or any other arrangement on the modular charge holder segment 200.

In one or more embodiments, modular charge holder segment 200 may comprise a slit, gap, opening or aperture 260 that permits the opening 254 to be increased (for example, the modular charge holder segment 200 is allowed to flex, splay or deform outward) so that a shaped charge may be disposed in or removed from the modular charge holder segment 200. The width of slit 260 may vary according to the shape, size, dimensions or any combination thereof of the shaped charge, the type or pliability of the material of the modular charge holder segment 200, any other factor or any combination thereof. In one or more embodiments, charge opening 254 may be sized smaller than a shaped charge as slit 260 is configured to deflect to permit the loading and downloading of the shaped charge. In one or more embodiments, charge opening 254 may be of a sufficient size such that slit 260 is not required.

In one or more embodiments, the modular charge holder segment 200 may comprise a plurality of arms 240 that operate within an arm opening 242. The arms 240 may move along the arm opening 242 so as to grasp a detonator cord (for example detonator cord 910 discussed further with respect to FIG. 9).

Figure 3A:
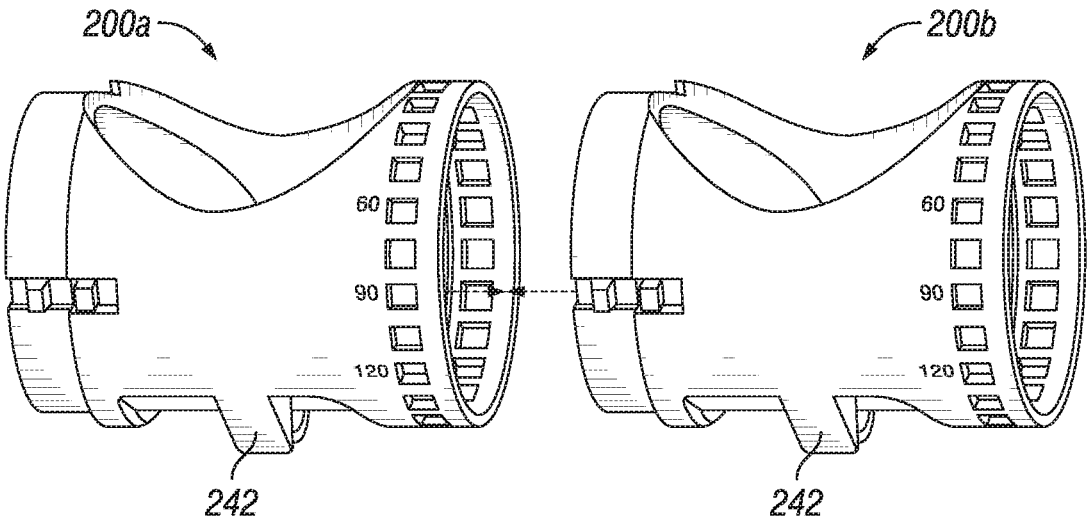
FIG. 3A is a diagram illustrating an example configuration of modular charge holder segments, according to aspects of the present disclosure.
Figure 3B:
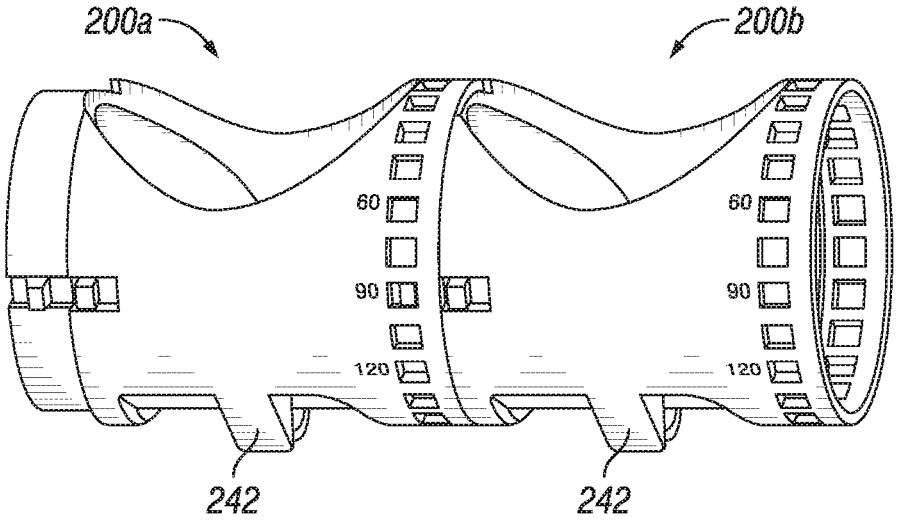
FIG. 3B is a diagram illustrating an example configuration of modular charge holder segments, according to aspects of the present disclosure.

FIG. 3A and FIG. 3B are diagrams illustrating an example configuration of modular charge holder segments 200, according to aspects of the present disclosure. FIG. 3A illustrates a modular charge holder segment 200*a* in position to mate with a modular charge holder segment 200*b* as indicated by the arrows. FIG. 3B illustrates the modular charge holder segment 200*a* and 200*b* mated such that the locking tab 210 of modular charge holder segment 200*b* is mated to or is in a locked position with slot 230 of modular charge holder segment 200*a*. While openings 250 of the modular charge holder segments 200*a* and 200*b* are illustrated at a zero degree phase from each other, the present disclosure contemplates that modular charge holder segments 200*a* and 200*b* may be mated or configured to be at any degrees of phase from each other.

Figure 4A:
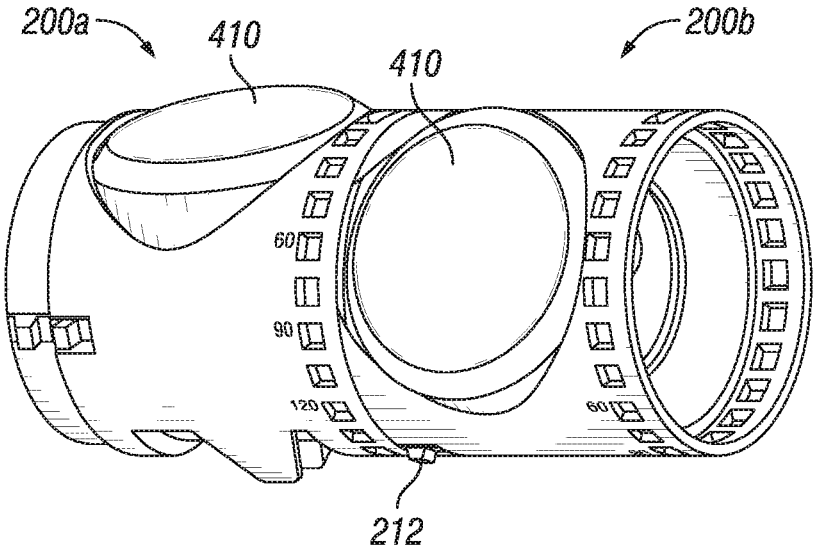
FIG. 4A is a diagram illustrating an example configuration of modular charge holder segments and explosive charges, according to aspects of the present disclosure.
Figure 4B:
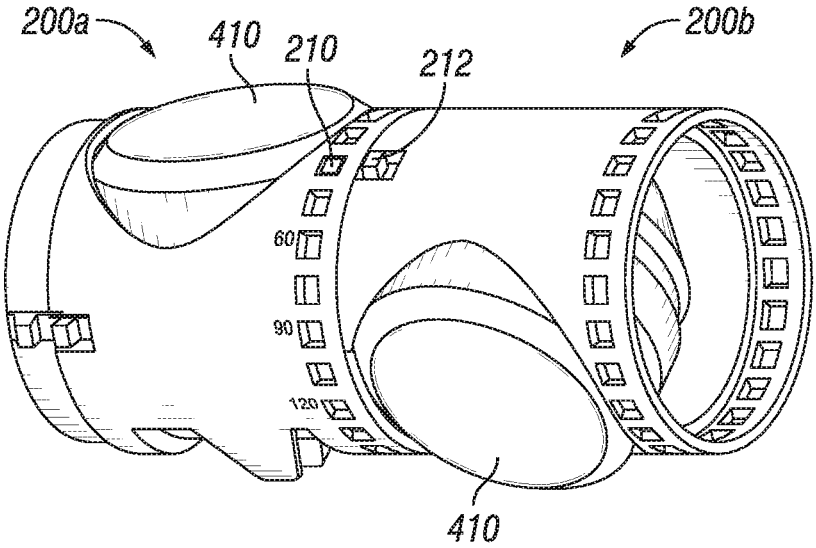
FIG. 4B is a diagram illustrating an example configuration of modular charge holder segments and explosive charges, according to aspects of the present disclosure.

FIG. 4A and FIG. 4B are diagrams illustrating an example configuration of modular charge holder segments and explosive charges, according to aspects of the present disclosure. FIG. 4A illustrates a shaped charge 410 disposed within a modular charge holder segment 200*a*. A shaped charge 410 is disposed within modular charge holder segment 200*b*. Modular charge holder segment 200*b* is coupled to modular charge holder segment 200*a* such that the shaped charge 410 of modular charge holder segment 200*b* is at a sixty degree phasing or offset to the shaped charge 410 of modular charge holder segment 200*a*. In one or more embodiments, modular charge holder segment 200*b* comprises a slit 260 and slit 260 may be used as a guide to align the shaped charge 410 of modular charge holder segment 200*b* to the desired or predetermined offset. For example, slit 260 may align with an indicator 280 associated with a sixty degree phasing or offset such that the locking tab 212 of modular charge holder segment 200*b* mates with a slot 230 of modular charge holder segment 200*a* to position the shaped charge 410 of the modular charge holder segment 200*b* at a sixty degree phasing or offset with the shaped charge 410 of modular charge holder segment 200*a*.

While FIG. 4A illustrates a sixty degree phasing or offset, the present disclosure contemplates any degree of phasing or offset. For example, FIG. 4B illustrates a 120 degree phasing or offset of shaped charge 410 of modular charge holder segment 200*b* with respect to the shaped charge 410 of modular charge holder segment 200*a*. Indicators 280 may indicate any one or more offsets or phasings.

Figure 5A:
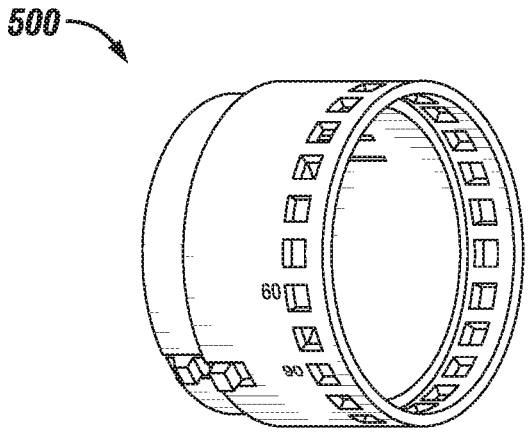
FIG. 5A is a diagram illustrating an example modular charge spacer segment, according to aspects of the present disclosure.

FIG. 5A is a diagram that illustrates an example modular charge spacer segment 500, according to aspects of the present disclosure. Modular charge spacer segment 500 and modular charge holder segment 200 may form a system to adapt to different setups to create a configuration for any number of shaped charges 410 per foot. Modular charge spacer segment 500 is similar to modular charge holder segment 200 except that modular charge spacer segment 500 does not include a charge opening 250. Modular charge spacer segment 500 includes a locking tab 210 and slots 230 so as to be mateable with one or more modular charge holder segments 200. Modular charge spacer segment 500 may be of any length and may be used to increase the distance between a first shaped charge, for example, shaped charge 410 in FIG. 4A, of a first modular charge holder segment 200 and a second shaped charge 410 of a second modular charge holder segment 200.

Figure 5B:
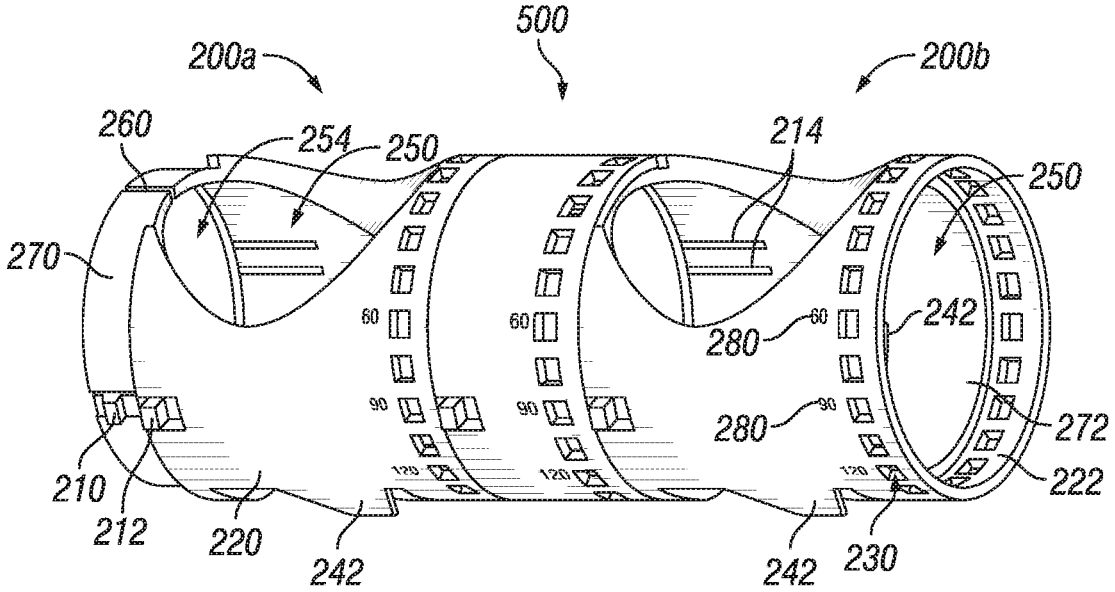
FIG. 5B is a diagram illustrating an example configuration of modular charge holder segments and modular charge space segment, according to aspects of the present disclosure.

FIG. 5B is a diagram that illustrates an example configuration of modular charge holder segments 200 and modular charge spacer segment 500, according to aspects of the present disclosure. A modular charge spacer segment 500 may be disposed between a first modular charge holder segment 200*a* and a second modular charge holder segment 200*b* to space the shaped charges 410 associated with each modular charge holder segment 200 a predetermined or desired distance apart. While only one modular charge spacer segment 500 is illustrated in FIG. 5B, the present disclosure contemplates any number of modular charge spacer segments 500 disposed between any two modular charge holder segments 200.

Figure 6A:
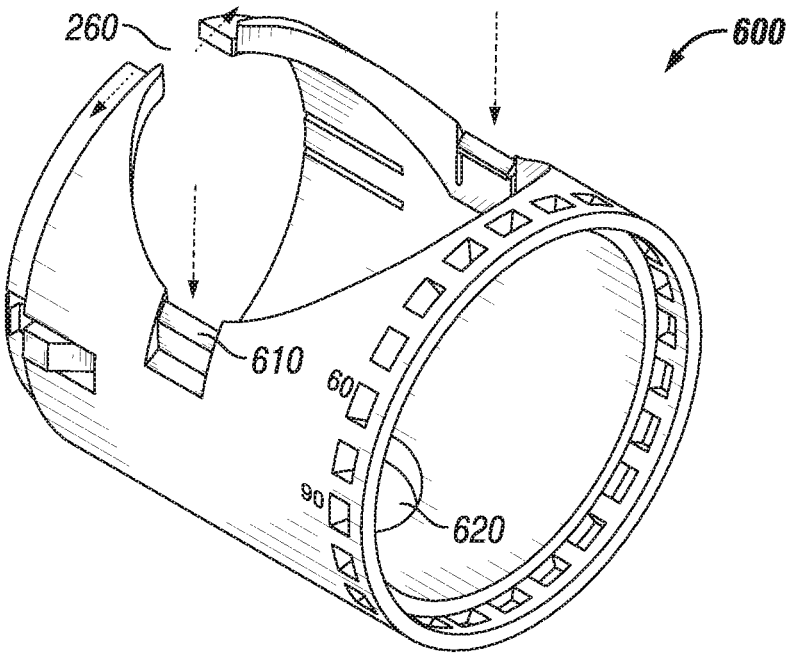
FIG. 6A is a diagram illustrating an example modular charge holder segment, according to aspects of the present disclosure.

FIG. 6A is a diagram illustrating an example modular charge holder segment 600, according to aspects of the present disclosure. Modular charge holder segment 600 is similar to modular charge holder segment 200. Modular charge holder segment 600 may comprise a bottom opening 620 to permit a bottom portion (see element 630 of FIG. 6B) of shaped charge 410 to protrude through so as to engage or compress against a detonator cable (see element 910 of FIG. 9). To increase efficiency and eliminate potential safety risks during loading and downloading of shaped charges, for example, shaped charges 410 in FIG. 4A, modular charge holder segment 600 may comprise side locking tabs 610 that engage with or mate to a corresponding receptacle or other mechanism (such as an indentation or mating mechanism) 640 of a shaped charge 410. Side locking tabs 610 may be any type of fastener, coupler, or other mechanism that permits the shaped charge 410 to be secured within the modular charge holder segment 600. Side locking tabs 610 may deflect or flex while the shaped charge 410 is being loaded into the modular charge holder segment 200. For downloading the shaped charge 410, a tool may be inserted between the shaped charge 410 and the side locking tabs 610 causing a deflection or flexion in the side locking tabs 610 that free the shaped charge 410. In one or more embodiments, side locking tabs 610 may not be required if modular charge holder segment 200 comprises a slit 260.

Figure 6B:
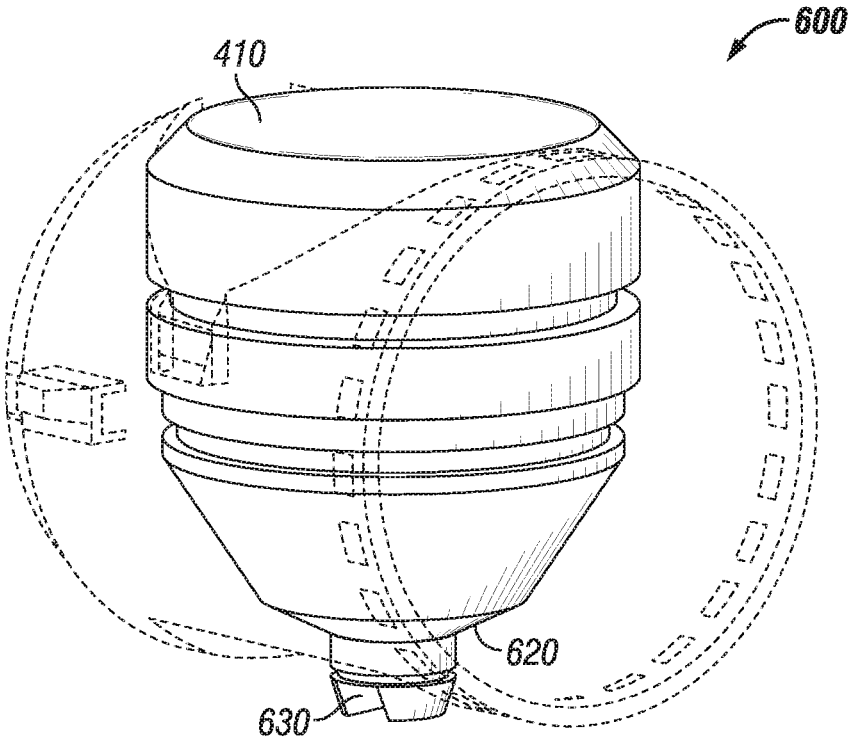
FIG. 6B is a diagram illustrating an example modular charge holder segment and a shaped charge, according to aspects of the present disclosure.

FIG. 6B is a diagram illustrating an example modular charge holder segment 600 and a shaped charge 410. Modular charge holder segment 600 is illustrated with a shaped charge 410 disposed within modular charge holder segment 600. A bottom portion 630 of the shaped charge 410 protrudes through the bottom opening 620. The bottom portion 630 may comprise a slot or groove that allows a detonator cable (see element 910 of FIG. 9) to engage or compress against shaped charge 410.

Figure 7A:
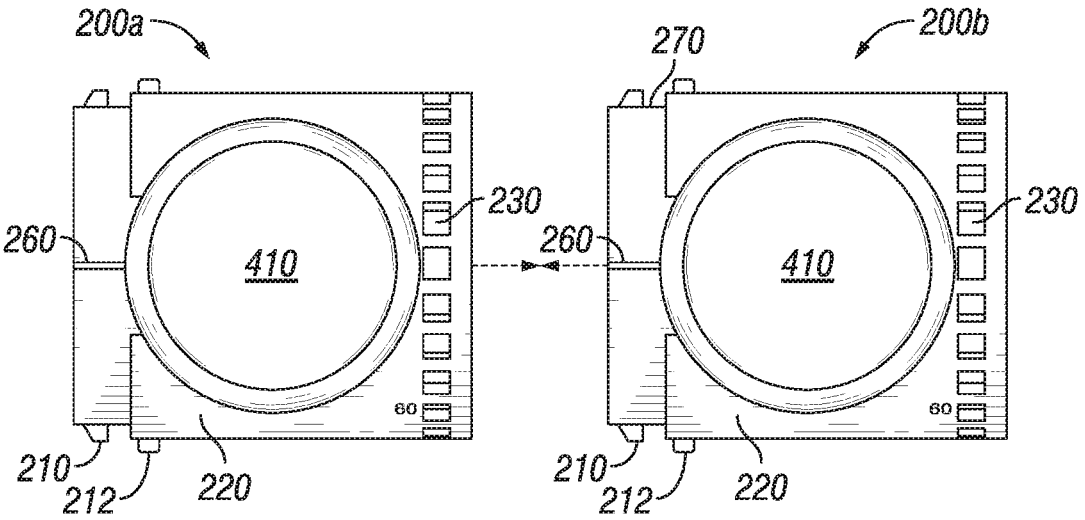
FIG. 7A is a diagram illustrating an example configuration of modular charge holder segments and shaped charges, according to aspects of the present disclosure.

FIG. 7A is a diagram that illustrates an example configuration of modular charge holder segments 200, according to aspects of the present disclosure. Modular charge holder segments 200*a* and 200*b* are configured to be mated as indicated by the arrows to secure corresponding shaped charges 410. The shaped charges 410 may be recessed at least partially below an outer surface 220 of the modular charge holder segments 200. A portion of one or more shaped charges 410 may extend at least partially over the male connector 270 and a portion of one or more shaped charges 410 may extend at least partially under female connector 272.

Figure 7B:
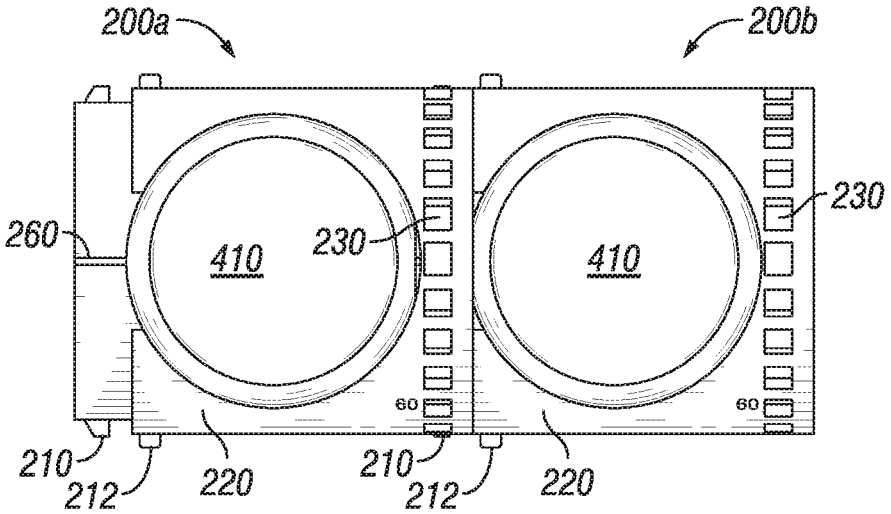
FIG. 7B is a diagram illustrating an example configuration of modular charge holder segments and shaped charges, according to aspects of the present disclosure.

FIG. 7B is a diagram that illustrates an example configuration of mated modular charge holder segments 200, according to aspects of the present disclosure. In one or more embodiments, when modular charge holder segments 200*a* and 200*b* are mated or coupled to together, female connector 272 of modular charge holder segment 200*a* may overlap the portion of shaped charge 410 of modular charge holder segment 200*b* that is recessed at least partially below the outer surface 220 of modular charge holder segment 200*b*, the male connector 270 of modular charge holder segment 200*b* may overlap the portion of the shaped charge 410 of modular charge holder segment 200*a* that is disposed partially below the female connector 272 of modular charge holder segment 200*a* or both to secure any one or more shaped charges 410.

Figure 8:
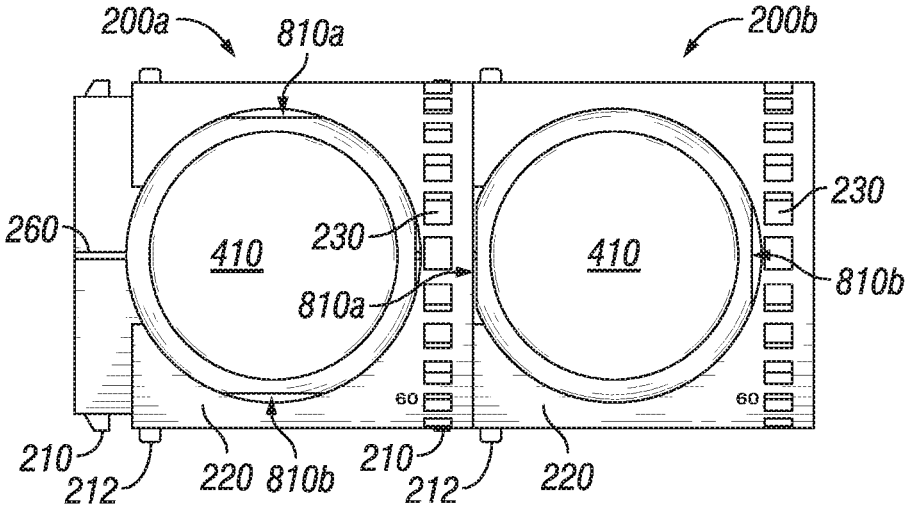
FIG. 8 is a diagram illustrating an example modular charge holder segments and shaped charges, according to aspects of the present disclosure.

FIG. 8 is a diagram illustrating an example modular charge holder segments 200 and shaped charges 410, according to aspects of the present disclosure. In one or more embodiments, shaped charges 410 may comprise two indentations or flat portions 810*a* and 810*b* disposed at or near 180 degrees apart as illustrated in FIG. 8. When indentations or flat portions 810 are not aligned with a female connector 272 and a male connector 270, the shaped charge 410 is in a locked positions as illustrated by the shaped charge 410 of modular charge segment 200*a*. When flat portions 810 are aligned with a female connector 272 and a male connector 270, the shaped charge 410 is in an unlocked positions.

In one or more embodiments, part of a perforating tool assembly 34 may comprise a modular charge holder segment 200*a* which may comprise a first female connector 272 disposed at a first end of the modular charge holder segment 200*a* and a first male connector 270 at a second end of the modular charge holder segment 200*a* and a modular charge holder segment 200*b* which may similarly comprise a second female connector 272 disposed at a first end of the modular charge holder segment 200*b* and a second male connector 270 at a second end of the modular charge holder segment 200*b*. The first shaped charge 410 disposed or positioned within the modular charge holder segment 200*a* illustrates a locked or secured position of the first shaped charge 410. The first shaped charge 410 may be positioned or disposed within the modular charge holder segment 200*a* such that the indentations or flat portions 810 are askew from or not completely aligned with the first female connector 272 and the first male connector 270. While FIG. 8 illustrates the indentations or flat portions 810 positioned at a substantially ninety degree angle from slit 260, the present disclosure contemplates any position of the indentations or flat portions 810 askew from the first female connector 272 and the first male connector 270 such that the second male connector 270 overlaps at least a portion of the first shaped charge 410 to place the first shaped charge 410 in a locked or secured position, for example, for deployment downhole. The second shaped charge 410 positioned or disposed within modular charge holder segment 200*b* illustrates an unlocked position for the second shaped charge 410. The indentations or flat portions 810 of the second shaped charge 410 are aligned with the first female connector 272 of the modular charge holder segment 200*a* and the second male connector 270 of the modular charge holder segment 200*b* such that no overlap occurs between the second shaped charge 410 and the first female connector 272 and the second male connector 270, for example, during loading or downloading.

Figure 9:
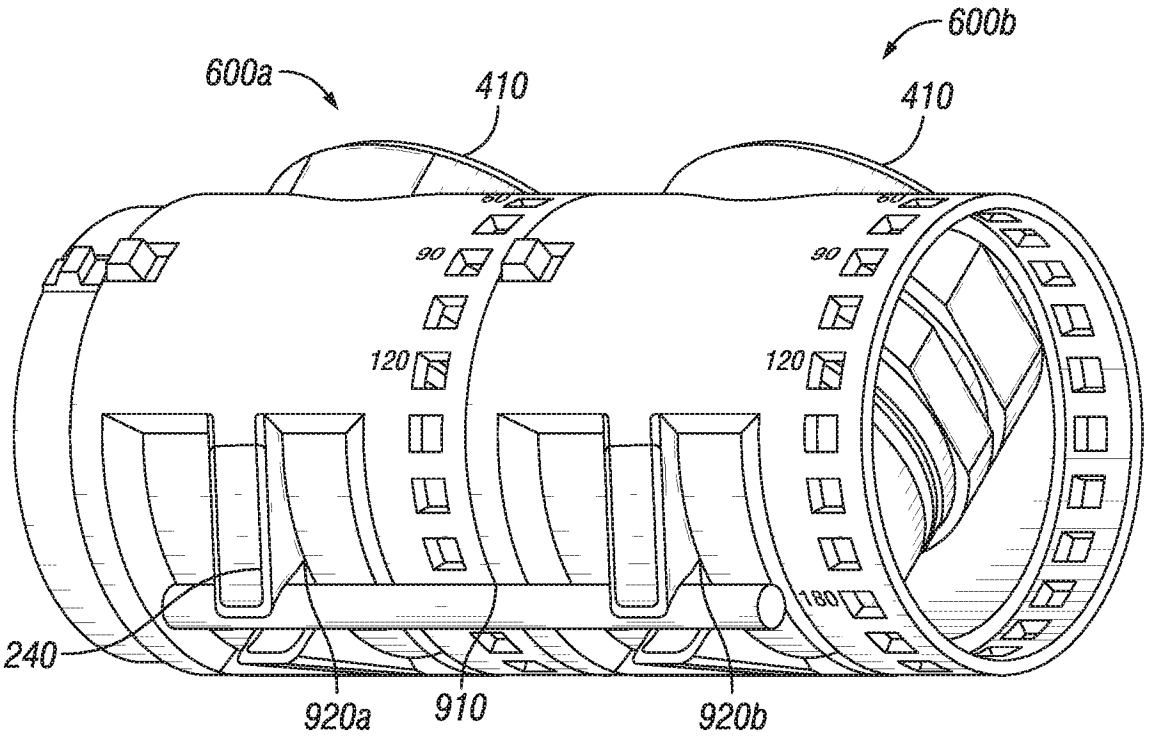
FIG. 9 is a diagram illustrating an example configuration of modular charge holder segments and shaped charges, according to aspects of the present disclosure.

FIG. 9 is a diagram illustrating an example configuration of modular charge holder segments 600 and shaped charges 410, according to aspects of the present disclosure. A detonator cable or cord 910 may couple to the outer surface 220 (as illustrated in FIG. 2) of modular charge holder segments 600*a* and 600*b*, for example, via one or more arms 240. To secure the detonation cable 910 the one or more arms 240 secure around the detonation cable 910 to compress the detonation cable 910 against a booster channel 920 or a bottom surface of the modular charge holder segment 600. The one or more arms 240 may eliminate the requirement for any secondary component to secure the detonator cable 910 to the shaped charge 410. Arms 240 may provide a safety feature as no metal clips are required to secure the detonator cable 910 which may damage the detonator cable 910 or cause harm to personnel. Further, arms 240 may allow for the modular charge holder segment 600 to be molded as a single unit. As illustrated, for example, in FIG. 6B, a shaped charge 410 may be ballistically coupled to the detonator cable 910 via a bottom portion 630 of the shaped charge 410 that extends through a bottom opening 620. The detonator cable 910 may be ballistically coupled to a detonator (not shown) and the detonator may be electrically coupled to an information handling system, a power cable, or any other communication or signaling line that is configured to supply an appropriate electrical source (for example, an electrical current or an electrical signal) to the cause the shaped charge 410 to ignite or explode. In one or more embodiments, any modular charge holder segment may be used, including modular charge holder segment 200.

In one or more embodiments, a perforating tool assembly comprises a first modular charge holder segment, an opening of the first modular charge holder segment, wherein the first modular charge holder segment is configured to receive a shaped charge, a first one or more slots disposed about the first modular charge holder segment, wherein the first one or more slots are disposed about the first modular charge holder segment to provide one or more offsets for the shaped charge and a first one or more locking tabs disposed on the first modular charge holder segment, wherein at least one of the first one or more locking tabs mate with at least one of a second one or more slots of a second modular charge holder segment, and wherein at least one of the first one or more slots mate with at least one of a second one or more locking tabs of a third modular charge holder segment. In one or more embodiments, a perforating tool assembly further comprises a modular charge spacer segment coupled to the first modular charge holder segment. In one or more embodiments, the first one or more slots are disposed to circumnavigate the first modular segment holder at predetermined intervals. In one or more embodiments, the perforating tool assembly further comprises a shaped charge disposed within the first modular charge holder segment, a male connector of the second modular charge holder segment disposed at a first end of the second modular charge holder segment, a female connector disposed at a first end of the first modular charge holder segment, wherein the first one or more slots are disposed about the female connector and wherein the male connector of the second modular charge holder segment overlaps a first portion of the shaped charge to secure the shaped charge. In one or more embodiments, the perforating tool assembly further comprises a second modular charge holder segment coupled to the first modular holder segment, a first shaped charge disposed within the first modular charge holder segment, a second shaped charge disposed within the second modular charge holder segment and wherein the first modular charge holder segment is coupled to the second modular charge holder segment such that the first shaped charge is at a first offset from the second shaped charge. In one or more embodiments, the perforating tool assembly further comprises an indicator associated with at least one of the first one or more slots, wherein the indicator indicates an offset. In one or more embodiments, the perforating tool assembly further comprises a side locking tab disposed about the first modular charge holder segment, wherein the side locking tab mates with a receptacle of the shaped charge to secure the shaped charge. In one or more embodiments, the perforating tool assembly further comprises a bottom opening disposed about the first modular charge holder segment, wherein the bottom opening is configured to receive a bottom portion of the shaped charge. In one or more embodiments, the perforating tool assembly further comprises a first shaped charge disposed within the first modular charge holder segment, a first female connector disposed at a first end of the first modular charge holder segment, wherein the first one or more slots are disposed about the female connector, a first male connector disposed at a second end of the first modular charge holder segment, a second shaped charge disposed within a second modular charge holder segment, a second male connector disposed at a first end of the second modular charge holder segment, wherein the first female connector overlaps a first portion of the second shaped charge to secure the second shaped charge and wherein the first male connector overlaps a first portion of the first shaped charge to secure the first shaped charge. In one or more embodiments, the perforating tool assembly further comprises a first shaped charge disposed within the first modular charge holder segment, wherein the first shaped charge comprises a first indentation, a first female connector disposed at a first end of the first modular charge holder segment, wherein the first one or more slots are disposed about the female connector, a first male connector disposed at a second end of the first modular charge holder segment, a second shaped charge disposed within a second modular charge holder segment and a second male connector disposed at a first end of the second modular charge holder segment, wherein the first indentation of the first shaped charge aligns with the second male connector to place the first shaped charge in an unlocked position.

In one or more embodiments, a method of configuring a perforating tool assembly comprises disposing a first shaped charge in a first modular charge holder segment via a first opening in the first modular charge holder segment, disposing a second shaped charge in a second modular charge holder segment via a second opening of the second modular charge holder segment, selecting a slot of the second modular charge holder segment to mate a first locking tab with the slot based, at least in part, on a predetermined offset of the first shaped charge to the second shaped charge, coupling the first modular charge holder segment to the second modular charge holder segment by mating the first locking tab of the first modular charge holder segment with the selected slot of the second modular charge holder segment and wherein the perforating tool assembly comprises the first modular charge holder segment and the second modular charge holder segment. In one or more embodiments, the method of configuring the perforating tool assembly further comprises disposing a modular charge spacer segment between the first modular charge holder segment and the segment modular charge holder segment. In one or more embodiments, the slot comprises a plurality of slots that circumnavigate the first modular segment holder at predetermined intervals. In one or more embodiments, the method of configuring the perforating tool assembly further comprises overlapping a first portion of the first shaped charge with a male connector of the second modular charge segment. In one or more embodiments, the method of configuring the perforating tool assembly further comprises determining the selected slot based, at least in part, on an indicator associated with the selected slot. In one or more embodiments, the method of configuring the perforating tool assembly further comprises mating a side locking tab of the first modular charge holder segment with a receptacle of the first shaped charge to secure the first shaped charge. In one or more embodiments, disposing the first shaped charge within the first modular charge holder segment comprises disposing a bottom portion of the first shaped charge through a bottom opening of the first modular charge holder segment. In one or more embodiments, the method of configuring the perforating tool assembly further comprises positioning a detonator cable between two or more arms of the first modular charge holder segment, wherein the two or more arms are disposed about a bottom portion of the first modular charge holder segment and coupling a detonator cable with the bottom portion of the first shaped charge, wherein the two or more arms align the detonator cable with the bottom opening of the first modular charge holder segment. In one or more embodiments, placing the first shaped charge in a locked position, wherein the placing in the locked position comprises overlapping a first portion of the first shaped charge of the first modular charge holder segment with a first male connector of the second modular charge segment holder and overlapping a first portion of the second shaped charge of the second modular charge holder segment with a first female connector of the first modular charge segment holder. In one or more embodiments, the method of configuring the perforating tool assembly further comprises placing the first shaped charge of the first modular charge holder segment in an unlocked position by aligning a first indentation at a first portion of the first shaped charge askew from the first male connector of the second charge holder segment.

The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Numerous modifications, adaptations, uses, and installations thereof can be apparent to those skilled in the art without departing from the scope of this disclosure. Also, the terms in the claims have their plain, ordinary meaning unless otherwise explicitly and clearly defined by the patentee. The indefinite articles “a” or “an,” as used in the claims, are defined herein to mean one or more than one of the element that it introduces.

What is claimed is:

1. A method of configuring a perforating tool assembly, comprising:

disposing a first shaped charge in a first modular charge holder segment via a first opening in the first modular charge holder segment;

disposing a second shaped charge in a second modular charge holder segment via a second opening of the second modular charge holder segment;

selecting a slot of the second modular charge holder segment to mate a first locking tab of the first modular charge holder segment with the slot based, at least in part, on a predetermined offset of the first shaped charge to the second shaped charge;

coupling the first modular charge holder segment to the second modular charge holder segment by mating the first locking tab of the first modular charge holder segment with the selected slot of the second modular charge holder segment; and placing the first shaped charge in a locked position by overlapping a first portion of the first shaped charge of the first modular charge holder segment with a first male connector of the second modular charge holder and overlapping a first portion of the second shaped charge of the second modular charge holder segment with a first female connector of the first modular charge holder segment;

wherein the perforating tool assembly comprises the first modular charge holder segment and the second modular charge holder segment.

2. The method of configuring the perforating tool assembly of claim 1, further comprising disposing a modular charge spacer segment between the first modular charge holder segment and a third modular charge holder segment.

3. The method of configuring the perforating tool assembly of claim 1, wherein the slot comprises a plurality of slots that circumnavigate the first modular charge holder segment at predetermined intervals.

4. The method of configuring the perforating tool assembly of claim 1, further comprising overlapping a first portion of the first shaped charge with a male connector of the second modular charge holder segment.

5. The method of configuring the perforating tool assembly of claim 1, further comprising determining the selected slot based, at least in part, on an indicator associated with the selected slot.

6. The method of configuring the perforating tool assembly of claim 1, further comprising mating a side locking tab of the first modular charge holder segment with a receptacle of the first shaped charge to secure the first shaped charge.

7. The method of configuring the perforating tool assembly of claim 1, wherein disposing the first shaped charge within the first modular charge holder segment comprises disposing a bottom portion of the first shaped charge through a bottom opening of the first modular charge holder segment.

8. The method of configuring the perforating tool assembly of claim 7, further comprising:

positioning a detonator cable between two or more arms of the first modular charge holder segment, wherein the two or more arms are disposed about a bottom portion of the first modular charge holder segment; and coupling a detonator cable with the bottom portion of the first shaped charge, wherein the two or more arms align the detonator cable with the bottom opening of the first modular charge holder segment.

9. The method of configuring the perforating tool assembly of claim 1, further comprising placing the first shaped charge of the first modular charge holder segment in an unlocked position by aligning a first indentation at a first portion of the first shaped charge askew from the first male connector of the second charge holder segment.

* * * * *